US010113748B2

(12) United States Patent
Braden et al.

(10) Patent No.: US 10,113,748 B2
(45) Date of Patent: Oct. 30, 2018

(54) GRIDDLE AND GAS BURNER RANGE HAVING A HEAT BARRIER

(71) Applicants: BSH Home Appliances Corporation, Irvine, CA (US); BSH Hausgeräte GmbH, Munich (DE)

(72) Inventors: Ben Braden, Lafollette, TN (US); Charlie Hanna, Knoxville, TN (US); Brian Silva, Knoxville, TN (US); Derek Turner, Caryville, TN (US)

(73) Assignees: BSH Home Appliances Corporation, Irvine, CA (US); BSH Hausgeräte GmbH, Munich (DE)

( * ) Notice: Subject to any disclaimer, the term of this patent is extended or adjusted under 35 U.S.C. 154(b) by 121 days.

(21) Appl. No.: 15/197,852

(22) Filed: Jun. 30, 2016

(65) Prior Publication Data

US 2018/0003393 A1 Jan. 4, 2018

(51) Int. Cl.

| | |
|---|---|
| ***F24C 1/00*** | (2006.01) |
| ***F24C 11/00*** | (2006.01) |
| ***F24C 1/04*** | (2006.01) |
| ***F24C 15/34*** | (2006.01) |
| *F24C 15/16* | (2006.01) |

(52) U.S. Cl.

CPC ..... *F24C 11/00* (2013.01); *F24C 1/04* (2013.01); *F24C 15/34* (2013.01); *F24C 15/166* (2013.01)

(58) Field of Classification Search

None

See application file for complete search history.

(56) References Cited

U.S. PATENT DOCUMENTS

| | | | | | |
|---|---|---|---|---|---|
| 3,008,406 | A * | 11/1961 | Reeves | F24C 15/18 | 126/39 J |
| 3,034,419 | A * | 5/1962 | Hillebrand | A47J 37/067 | 126/39 H |
| 3,632,982 | A * | 1/1972 | Linger | H05B 3/68 | 219/448.17 |
| 4,042,806 | A * | 8/1977 | McCartney | A47J 37/0676 | 126/21 A |
| 4,598,634 | A * | 7/1986 | Van Horn, II | A47J 37/067 | 99/340 |
| 5,353,781 | A * | 10/1994 | Calvillo | F24C 15/12 | 126/221 |
| 6,903,309 | B2 * | 6/2005 | Rhinehart | F24C 15/101 | 219/451.1 |
| 7,856,972 | B2 | 12/2010 | Lee et al. | | |
| 8,074,563 | B2 * | 12/2011 | Bowles | A47J 37/067 | 219/436 |

(Continued)

FOREIGN PATENT DOCUMENTS

| | | | |
|---|---|---|---|
| CN | 2407263 | Y | 11/2000 |
| CN | 101182929 | B | 3/2011 |
| EP | 0627599 | A2 | 12/1994 |

*Primary Examiner* — Thor Campbell

(74) *Attorney, Agent, or Firm* — Michael E. Tschupp; Andre Pallapies; Brandon G. Braun

(57) ABSTRACT

A griddle and gas burner range, including: a griddle having an electric heating element, and a griddle plate that is disposed over the electric heating element; at least one open top gas burner disposed adjacent to the griddle; and a heat barrier installed between the griddle and the at least one open top gas burner, so as to block the escape of heat from the griddle and into an area of the at least one open top gas burner during operation of the griddle.

17 Claims, 5 Drawing Sheets

(56) References Cited

U.S. PATENT DOCUMENTS

| | | | | |
|---|---|---|---|---|
| 8,151,698 | B2 * | 4/2012 | Mehta | F24C 15/14 99/425 |
| 8,757,138 | B2 | 6/2014 | Shaffer et al. | |
| 9,072,403 | B2 * | 7/2015 | Braden | A47J 37/108 |
| 9,182,128 | B2 * | 11/2015 | Brantley | F24C 15/12 |
| 9,357,879 | B2 * | 6/2016 | Ortner | A47J 37/0676 |
| 9,631,817 | B2 * | 4/2017 | Cadima | F24C 1/06 |
| 9,723,954 | B2 * | 8/2017 | Bringe | A47J 37/067 |
| 9,782,039 | B2 * | 10/2017 | Ortner | A47J 37/067 |
| 2008/0060634 | A1 * | 3/2008 | Blum | A47J 37/067 126/369 |
| 2009/0126715 | A1 * | 5/2009 | Grassi | F24C 3/126 126/39 R |
| 2012/0111312 | A1 * | 5/2012 | Kim | F24C 15/10 126/214 C |
| 2013/0292371 | A1 * | 11/2013 | Braden | A47J 37/10 219/452.11 |
| 2017/0023254 | A1 * | 1/2017 | Cadima | F24C 1/06 |

* cited by examiner

GRIDDLE AND GAS BURNER RANGE HAVING A HEAT BARRIER

FIELD OF THE INVENTION

The present disclosure relates to a griddle and gas burner range and, more particularly, to a heat barrier that reduces hot air or heat under the griddle plate from escaping to the burners.

BACKGROUND OF THE INVENTION

In general, for proper performance, open top gas burners require a balanced mix of primary air, fuel, and secondary air. If this balance is disrupted, the quality of the flame of open top gas burners is adversely affected.

However, during operation of a griddle plate, hot air or heat is expelled into adjacent areas above aeration pans of the open top gas burners. This hot air or heat affects the flame of the open top gas burners because the air/gas mixture is incorrect.

SUMMARY OF THE INVENTION

An apparatus consistent with the present disclosure is directed to improving the overall performance of an open top gas burner which is disposed adjacent to a griddle and during operation of the griddle.

An apparatus consistent with the present disclosure prevents the heated air or heat from the operating griddle from being expelled into the area above the adjacent aeration pans of the open top gas burners.

An apparatus consistent with the present disclosure provides a heat barrier installed between the griddle and burner area so as to eliminate the escape of hot air or heat.

According to one aspect, the present disclosure provides a griddle and gas burner range, including: a griddle comprising an electric heating element, and a griddle plate that is disposed over the electric heating element; at least one open top gas burner disposed adjacent to the griddle; and a heat barrier installed between the griddle and the at least one open top gas burner, so as to block the escape of heat from the griddle and into an area of the at least one open top gas burner during operation of the griddle.

According to another aspect, the present disclosure provides a griddle and gas burner range, wherein the heat barrier comprises an elongated plate disposed in a fire box of the griddle, and wherein the elongated plate extends upward to a height above an edge of the fire box.

According to another aspect, the present disclosure provides a griddle and gas burner range, wherein the heat barrier has a mounting flange on at least one end thereof.

According to another aspect, the present disclosure provides a griddle and gas burner range, wherein the mounting flange has a groove configured to fit over the electric heating element of the griddle and a through-hole which aligns with an existing mounting hole for mounting the electric heating element of the griddle to the fire box.

According to another aspect, the present disclosure provides a griddle and gas burner range, wherein a fastener is operative to mount the heat barrier by passing through the through-hole and the existing mounting hole for engagement with the fire box.

According to another aspect, the present disclosure provides a griddle and gas burner range, wherein the mounting flange extends substantially perpendicularly from the elongated plate of the heat barrier.

According to another aspect, the present disclosure provides a griddle and gas burner range, wherein the elongated plate of the heat barrier comprises a lower flange that rests on a bottom portion of the fire box.

According to another aspect, the present disclosure provides a griddle and gas burner range, wherein the griddle plate provides a cooking surface on a top surface thereof.

According to another aspect, the present disclosure provides a griddle and gas burner range, wherein the heat barrier comprises an elongated plate disposed in a fire box of the griddle, wherein a gap is formed between an upper portion of the edge of the fire box and a lower surface of the griddle plate, and wherein the elongated plate extends upward to a height above the upper portion of the edge of the fire box, so as to extend above the gap and block the escape of heat from the griddle and into an area of the at least one open top gas burner.

According to another aspect, the present disclosure provides a griddle and gas burner range, wherein the area of the at least one open top gas burner comprises an area above an aeration pan of the at least one open top gas burner.

According to another aspect, the present disclosure provides a griddle and gas burner range, wherein the at least one open top gas burner comprises a plurality of open top gas burners.

According to another aspect, the present disclosure provides a griddle and gas burner range, wherein the plurality of open top gas burners comprises two.

According to another aspect, the present disclosure provides a griddle and gas burner range, wherein the plurality of open top gas burners comprises four.

According to another aspect, the present disclosure provides a griddle and gas burner range, wherein the plurality of open top gas burners comprises two on one side of the griddle and two on an opposite side of the griddle, and wherein the heat barrier is disposed between the griddle and the two open top gas burners on the one side of the griddle, and a separate heat barrier is disposed between the griddle and the two open top gas burners on the opposite side of the griddle.

According to another aspect, the present disclosure provides a griddle and gas burner range, wherein the elongated plate of the heat barrier comprises a tab at a front portion of the elongated plate and which slides under a portion of the fire box.

According to another aspect, the present disclosure provides a griddle and gas burner range, comprising: a griddle comprising an electric heating element, and a griddle plate that is disposed over the electric heating element; at least one open top gas burner disposed adjacent to the griddle; and means for blocking the escape of heat from the griddle and into an area of the at least one open top gas burner during operation of the griddle, thereby to enhance the quality of a flame of the at least one open top gas burner.

According to another aspect, the present disclosure provides a griddle and gas burner range wherein the means for blocking the escape of heat from the griddle comprises a heat barrier installed between the griddle and the at least one open top gas burner.

According to another aspect, the present disclosure provides a griddle and gas burner range, wherein the heat barrier comprises an elongated plate disposed in a fire box of the griddle, wherein a gap is formed between an upper portion of the edge of the fire box and a lower surface of the griddle plate, and wherein the elongated plate extends upward to a height above the upper portion of the edge of the fire box, so as to extend above the gap and block the escape of heat from the griddle and into an area of the at least one open top gas burner.

According to another aspect, the present disclosure provides a griddle and gas burner range, wherein the heat barrier has a mounting flange on at least one end thereof.

According to another aspect, the present disclosure provides a heat barrier configured to block the escape of heat from a griddle and into an area of at least one adjacent open top gas burner during operation of the griddle, the heat barrier comprising: an elongated plate adapted to be disposed in an element tray of the griddle and having a mounting flange on at least one end thereof, wherein the mounting flange has a groove configured to fit over an electric heating element of the griddle and a through-hole for alignment with an existing mounting hole for mounting the electric heating element of the griddle to the element tray.

BRIEF DESCRIPTION OF THE DRAWING FIGURES

The accompanying drawing figures incorporated in and forming a part of this specification illustrate several aspects of the invention, and together with the description serve to explain the principles of the invention.

Figure 4:
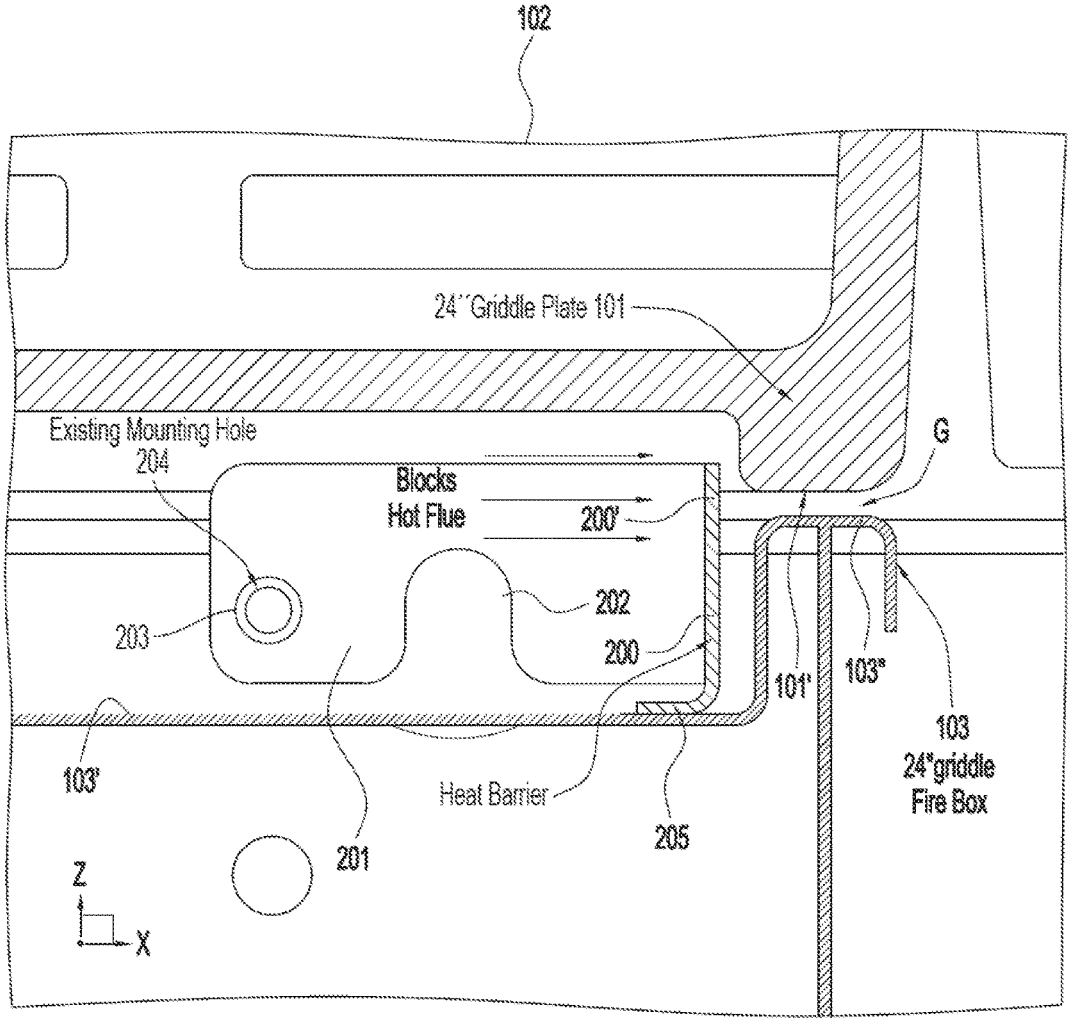
Figure 5:
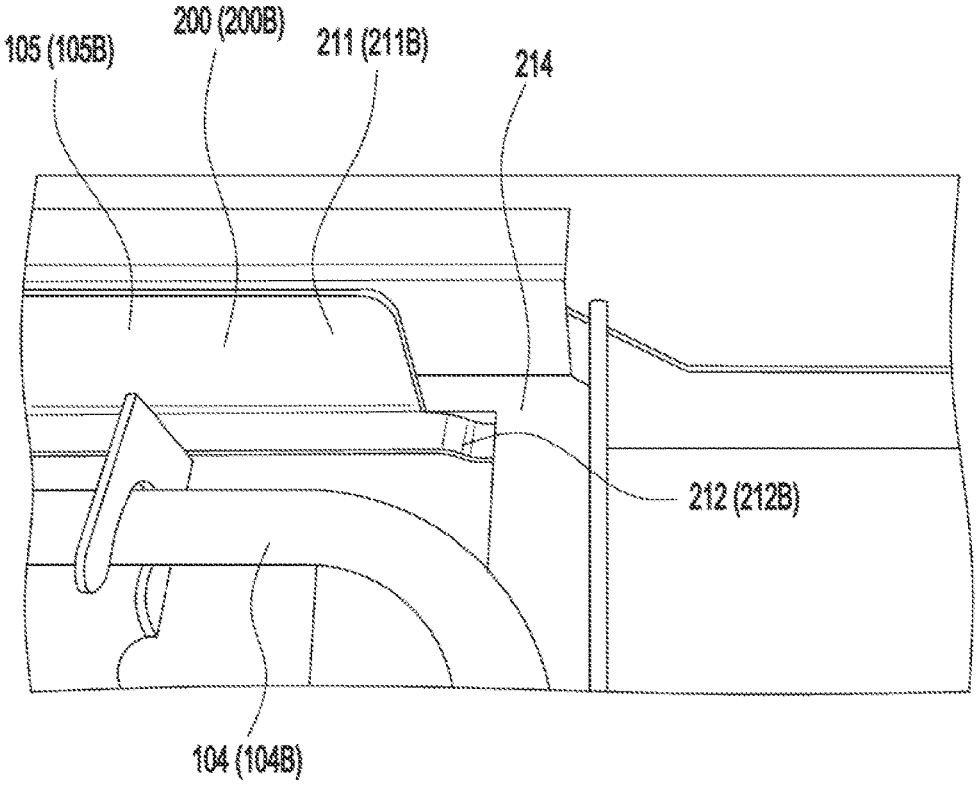

FIG. 4 is an enlarged explanatory view of the connection of the heat barrier (in this case the right side heat barrier) to a fire box of a griddle and gas burner range according to an exemplary embodiment consistent with present disclosure; and FIG. 5 is an enlarged view of the front end portion of the heat barrier (in this case the right side heat barrier) of a griddle and gas burner range according to an exemplary embodiment consistent with present disclosure.

DETAILED DESCRIPTION OF THE EXEMPLARY EMBODIMENTS

The exemplary embodiments set forth below represent the necessary information to enable those skilled in the art to practice the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

Moreover, it should be understood that terms such as top, bottom, front, rear, upper, lower, upward, downward, right, left, right side, left side, and the like used herein are for orientation purposes with respect to the drawings when describing the exemplary embodiments and should not limit the present invention.

The present inventors tested a cooktop of a 60 inch range having a 24 inch griddle and open top gas burners which are disposed adjacent to a griddle, and discovered that the leveling, expansion, and twisting motion of the griddle plate during operation of the griddle was expelling hot air or heat into the adjacent areas above the aeration pans of the open top gas burners. As a result, the heat from under the griddle plate would escape and adversely affect the open top gas burner performance.

More specifically, when the hot air or heat from the griddle plate is expelled into the adjacent areas above the aeration pans of the open top gas burners, the flames of the open top gas burners appear to be "lazy." A lazy flame occurs when the air/gas mixture tends to have too much gas so that the flame has poor combustion and elongates because the flame is reaching for additional air to properly balance the air/gas mixture.

The hot air or heat from the griddle plate that is expelled into the adjacent areas above the aeration pans of the open top burners also adversely affects the performance of the griddle plate per se as heat is lost and thus adversely affects the temperature performance of the griddle plate.

An apparatus consistent with the present disclosure prevents the heated air or heat from the operating griddle from being expelled into the area above the adjacent aeration pans of the open top gas burners.

Figure 1A:
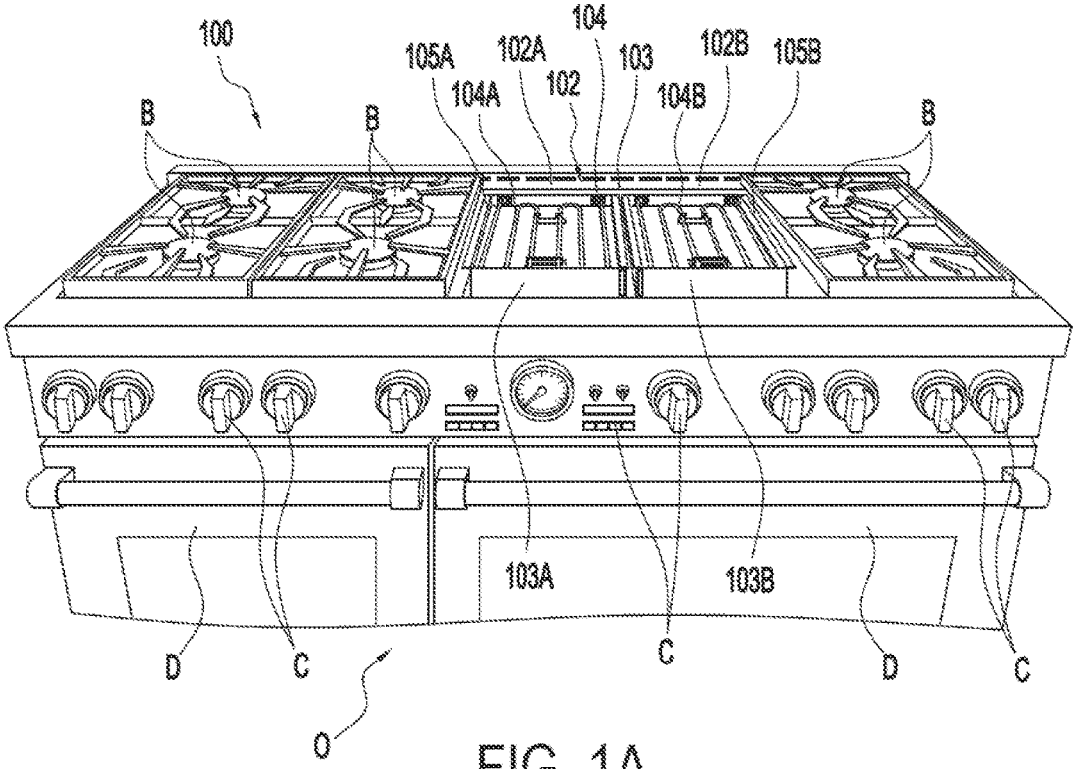
FIG. 1A illustrates a griddle and gas burner range according to an exemplary embodiment consistent with present disclosure, with the griddle plate removed.
Figure 1B:
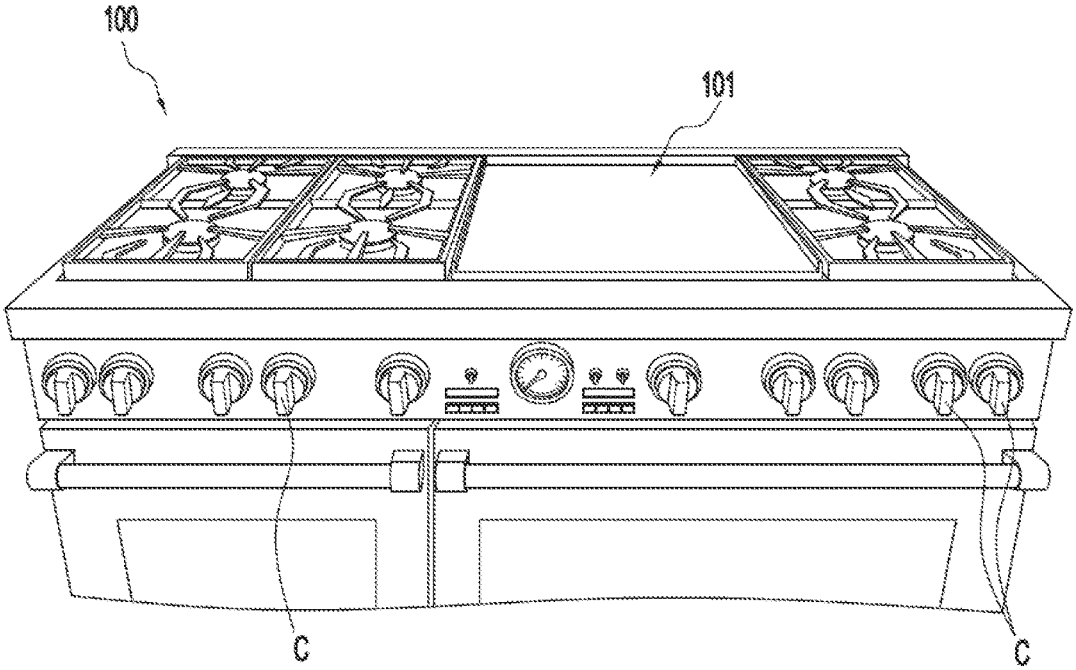
FIG. 1B is a view similar to FIG. 1A, but with the griddle plate in place.

FIG. 1A shows a griddle and gas burner range 100 according to an exemplary embodiment consistent with present disclosure. More specifically, the griddle and gas burner range 100 is shown with a griddle plate 101 removed. FIG. 1B shows the griddle and gas burner range 100 with the griddle plate 101 in place.

The griddle and gas burner range 100 is shown as a 60 inch range with six (6) burners and a 24 inch griddle, although this configuration is only exemplary and other configurations are within the scope of this invention. For example, four (4) burners, with two burners on each side of the griddle, or two (2) burners on just one side of the griddle, or just one (1) burner on one side or both sides of the griddle are also contemplated. Each open top gas burner B includes an aeration pan B" which provides support for a corresponding cooking grate B' on which various cooking pots or pans are placed during cooking. Each of the open top gas burners B may include a gas mixer tube for conducting gas and air to within the open top gas burners B, and each mixer tube has a mixer head with an adjustable air shutter for individually adjusting the gas-air mixture to the individual burners, as is conventional and thus not shown. Also, open top gas burners B that do not use an adjustable air mixer may be used, as is conventional.

The griddle and gas burner range 100 includes a griddle 102 disposed between a plurality of open top gas burners B. As noted above, six burners B are shown in FIG. 1A as exemplary. The griddle 102 includes a fire box or griddle element tray 103 and may be divided into left and right portions 102A and 102B. Each portion 102A and 102B has a corresponding fire box portion 103A and 103B. An electric heating element 104 includes an electric heating element portion 104A that is disposed in the fire box portion 103A, and an electric heating element portion 104B that is disposed in the fire box portion 103B. The two electric heating element portions 104A and 104B can be, for example, resistive electric heating elements and can be independently controlled by a user.

As will be described in more detail below, a heat barrier 105 is installed between the griddle and burner area so as to eliminate the escape of hot air or heat. In the exemplary embodiment shown in FIG. 1A, because there are open top gas burners B on both sides of the griddle 102, the heat barrier 105 comprises a left side heat barrier 105A that is disposed between the left griddle portion 102A and the two adjacent open top gas burners B on the left side of the griddle 102, and a right side heat barrier 105B that is disposed between the right griddle portion 102B and the two adjacent open top gas burners B on the right side of the griddle 102. The left side and right side heat barriers 105A and 105B, respectively, are mirror images of each other. Accordingly, when referring to the various elements of the left side and right side heat barriers 105A and 105B, hereinbelow the reference numerals include an "A" thereafter for the left side heat barrier 105A and a "B" thereafter for the right side heat barrier 105B. Also, when referring to various elements of the heat barrier 105 in general, no letter will be included after the reference numeral.

As shown in FIG. 1B, the griddle plate 101 is disposed over the griddle 102 and provides a cook top surface over each griddle portion 102A and 102B. In normal use, the heat barrier 105 is disposed under the griddle plate 101 and thus is not seen by the user. However, the griddle plate 101 is removable for accessing the electric heating elements 104A and 104B and the fire box 103 in general for service and/or cleaning, and for cleaning the griddle plate 101 per se. When in position over the fire box 103, the griddle plate 101 forms a gap G (see FIG. 4) between a lower surface thereof and an upper portion of the edge of the fire box 103, as will be discussed in detail below.

A plurality of manual controls C is disposed, for example, on a front face of the griddle and gas burner range 100. For example, individual controls can be provided for each open top gas burner B and for the each griddle portion 102A and 102B. Further, controls for the oven portion O of the range 100 are also provided. The oven portion O is shown, for example, as two side-by-side ovens, with an upper portion of the two doors D to the oven portion O being shown in FIG. 1A. The oven portion O per se is conventional, so that the details thereof will be dispensed with for the sake of brevity.

The particulars of the heat barrier 105 according to an exemplary embodiment consistent with present disclosure will now be described with reference to FIGS. 2A, 2B, 3B, 3B, 4, and 5. The heat barrier 105 constitutes means for blocking the escape of heat from the griddle and into an area of the at least one open top gas burner during operation of the griddle, thereby to enhance the quality of a flame of the at least one open top gas burner.

Figure 2A:
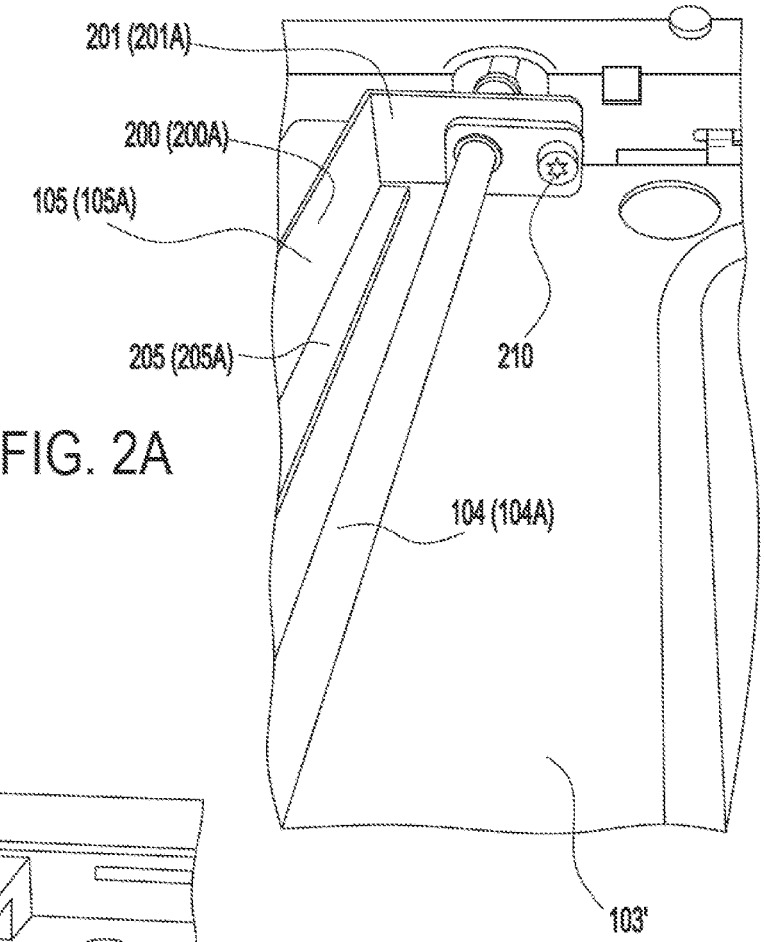
FIGS. 2A and 2B show a left side heat barrier in place on a griddle and gas burner range according to an exemplary embodiment consistent with present disclosure.
Figure 2B:
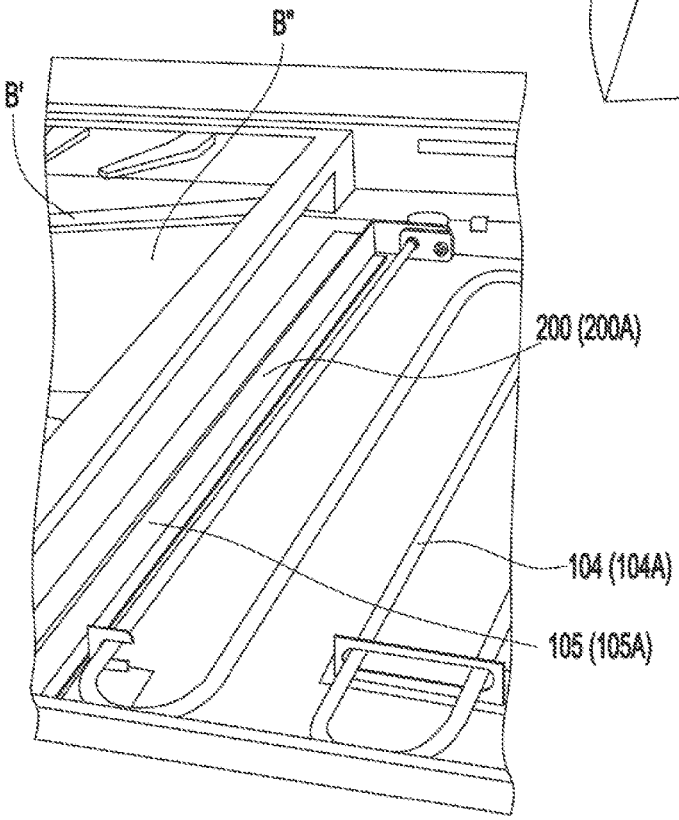

In particular, with reference to FIGS. 2A, 2B, and 4, the heat barrier 105 (105A, 105B) comprises an elongated plate 200 (200A, 200B) disposed in a fire box 103 of the griddle 102. The elongated plate 200 extends upward to a height above an edge of the fire box 103 (see FIG. 4). The heat barrier 105 has a mounting flange 201 (201A, 201B) on at least one end of the elongated plate 200 (e.g., a rear end). The mounting flange 201 extends substantially perpendicularly from the elongated plate 200 of the heat barrier 105.

Figure 3A:
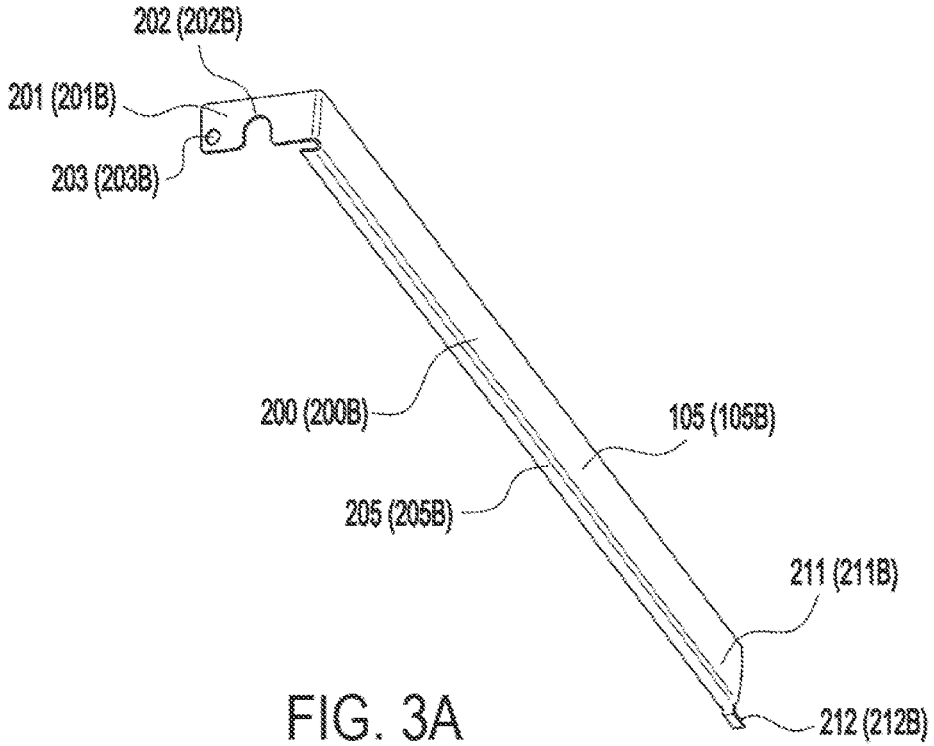
FIGS. 3A and 3B show a right side heat barrier and a left side heat barrier, respectively; removed from the griddle and gas burner range according to an exemplary embodiment consistent with present disclosure.
Figure 3B:
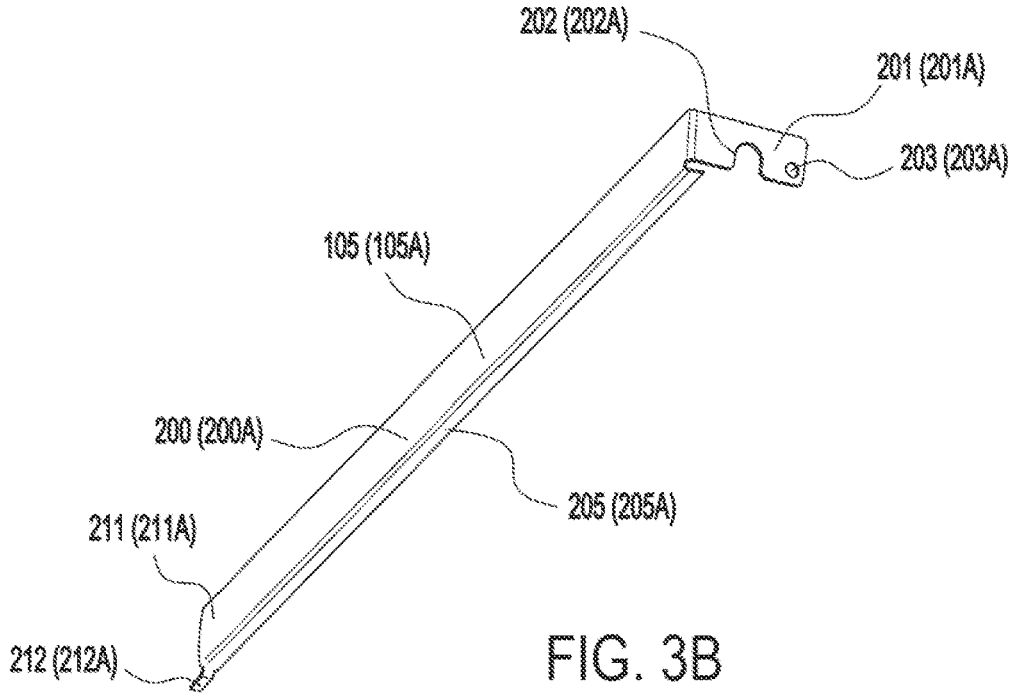

As best seen in FIGS. 3A and 3B, the mounting flange 201 (201A, 201B) has a groove or cutout 202 (202A, 202B) for fitting over the electric heating element 104 (104A, 104B) of the griddle 102 and a through-hole 203 (203A, 203B) for alignment with an existing mounting hole 204 (see FIG. 4—note that the portions of the heating element 104B that would have normally been in view have been removed for ease of understanding in FIG. 4) for mounting the electric heating element 104 (104A, 104B) of the griddle 102 to the fire box 103. A fastener 210 such as a screw or bolt (see FIG. 2A) is operative to mount the heat barrier 105 (105A, 105B) by passing through the through-hole 203 (203A, 203B) and the existing mounting hole 204 for engagement with the fire box 103.

As best shown in FIGS. 2A and 4, the elongated plate 200 of the heat barrier 105 comprises a lower flange 205 (205A, 205B) that rests on a bottom portion 103' of the fire box 103.

Further, as best shown in FIG. 4, the gap G is formed between an upper portion 103" of the edge of the fire box 103 and a lower surface 101' of the griddle plate 101. The elongated plate 200 extends upward to a height 200' above the upper portion 103" of the edge of the fire box 103, so as to extend above the gap G and block the escape of heat from the griddle 102 and into an area of at least one open top gas burner B. The area of the open top gas burner B comprises an area above the aeration pan B" (see FIG. 2B) of the at least one open top gas burner B.

With reference to FIGS. 3A, 3B, and 5, the front end portion 211 (211A, 211B) of the heat barrier 105 (105A, 105B) includes a tab 212 (212A, 212B) which slides under an existing portion such as a cutout 214 in the fire box 103.

The heat barrier 105 (105A, 105B) can be made from any material that can withstand the heat from the electric heating element 104 (104A, 104B) of ~550° F. while having some reflective properties. Suitable materials include, but are not limited to, various kinds of steels, or aluminum, or porcelain. Steel or aluminum is preferred.

The present invention has substantial opportunity for variation without departing from the spirit or scope of the present invention. For example, the number of open top gas burners B, the number oven portions O, the size of the range, the size of the griddle can all be varied.

Those skilled in the art will recognize improvements and modifications to the exemplary embodiments of the present invention. All such improvements and modifications are considered within the scope of the concepts disclosed herein and the claims that follow.

What is claimed is:

1. A griddle and gas burner range, comprising:

a griddle comprising an electric heating element, and a griddle plate that is disposed over the electric heating element;

at least one open top gas burner disposed adjacent to the griddle; and a heat barrier installed between the griddle and the at least one open top gas burner, so as to block the escape of heat from the griddle and into an area of the at least one open top gas burner during operation of the griddle, wherein the heat barrier comprises an elongated plate disposed in a fire box of the griddle and which extends upward in a height direction to a height above an edge of the fire box, wherein the heat barrier has a mounting flange on at least one end thereof, and wherein the mounting flange extends substantially perpendicular from the elongated plate and also extends upward in the height direction.

2. The griddle and gas burner range of claim 1, wherein the elongated plate of the heat barrier comprises a lower flange that rests on a bottom portion of the fire box.

3. The griddle and gas burner range of claim 1, wherein the griddle plate provides a cooking surface on a top surface thereof.

4. The griddle and gas burner range of claim 1, wherein the area of the at least one open top gas burner comprises an area above an aeration pan of the at least one open top gas burner.

5. The griddle and gas burner range of claim 1, wherein the at least one open top gas burner comprises a plurality of open top gas burners.

6. The griddle and gas burner range of claim 5, wherein the plurality of open top gas burners comprises two.

7. The griddle and gas burner range of claim 5, wherein the plurality of open top gas burners comprises four.

8. The griddle and gas burner range of claim 5, wherein the plurality of open top gas burners comprises two on one side of the griddle and two on an opposite side of the griddle, and wherein the heat barrier is disposed between the griddle and the two open top gas burners on the one side of the griddle, and a separate heat barrier is disposed between the griddle and the two open top gas burners on the opposite side of the griddle.

9. The griddle and gas burner range of claim 1, wherein the elongated plate of the heat barrier comprises a tab at a front portion of the elongated plate and which slides under a portion of the fire box.

10. A griddle and gas burner range, comprising:

a griddle comprising an electric heating element, and a griddle plate that is disposed over the electric heating element;

at least one open top gas burner disposed adjacent to the griddle; and means for blocking the escape of heat from the griddle and into an area of the at least one open top gas burner during operation of the griddle, thereby to enhance the quality of a flame of the at least one open to gas burner, wherein the means for blocking the escape of heat from the griddle comprises a heat barrier installed between the griddle and the at least one open top gas burner, wherein the heat barrier comprises an elongated plate disposed in a fire box of the griddle, wherein a gap is formed between an upper portion of an edge of the fire box and a lower surface of the griddle plate, and wherein the elongated plate extends upward to a height above the upper portion of the edge of the fire box, so as to extend above the gap and block the escape of heat from the griddle and into an area of the at least one open top gas burner.

11. The griddle and gas burner range of claim 10, wherein the heat barrier has a mounting flange on at least one end thereof.

12. A griddle and gas burner range, comprising:

a griddle comprising an electric heating element, and a griddle plate that is disposed over the electric heating element;

at least one open top gas burner disposed adjacent to the griddle; and a heat barrier installed between the griddle and the at least one open top gas burner, so as to block the escape of heat from the griddle and into an area of the at least one open top gas burner during operation of the griddle, wherein the griddle plate provides a cooking surface on a top surface thereof, wherein the heat barrier comprises an elongated plate disposed in a fire box of the griddle, wherein a gap is formed between an upper portion of an edge of the fire box and a lower surface of the griddle plate, and wherein the elongated plate extends upward to a height above the upper portion of the edge of the fire box, so as to extend above the gap and block the escape of heat from the griddle and into an area of the at least one open top gas burner.

13. A griddle and gas burner range, comprising:

a griddle comprising an electric heating element, and a griddle plate that is disposed over the electric heating element;

at least one open top gas burner disposed adjacent to the griddle; and means for blocking the escape of heat from the griddle and into an area of the at least one open top gas burner during operation of the griddle, thereby to enhance the quality of a flame of the at least one open top gas burner, wherein the means for blocking the escape of heat from the griddle comprises a heat barrier installed between the griddle and the at least one open top burner, wherein the heat barrier comprises an elongated plate disposed in a fire box of the griddle and which extends upward in a height direction to a height above an edge of the fire box, wherein the heat barrier has a mounting flange on at least one end thereof, and wherein the mounting flange extends substantially perpendicularly from the elongated plate and also extends upward in the height direction.

14. A heat barrier configured to block the escape of heat from a griddle and into an area of at least one adjacent open top gas burner during operation of the griddle, the heat barrier comprising:

an elongated plate adapted to be disposed in an element tray of the griddle and having a mounting flange on at least one end thereof, wherein the elongated plate is configured to be disposed in a fire box of the griddle and extend upward substantially vertically in a height direction to a height above an edge of the fire box, wherein the mounting flange extends substantially perpendicularly from the elongated plate and also extends upward substantially vertically in the height direction, and wherein the mounting flange has a groove configured to fit over an electric heating element of the griddle and a through-hole for alignment with an existing mounting hole for mounting the electric heating element of the griddle to the element tray.

15. A griddle and gas burner range, comprising:

a griddle comprising an electric heating element, and a griddle plate that is disposed over the electric heating element;

at least one open top gas burner disposed adjacent to the griddle; and a heat barrier installed between the griddle and the at least one open top gas burner, the heat barrier comprising an elongated plate disposed in a fire box of the griddle and which extends upward in a height direction to a height above an edge of the fire box, so as to block the escape of heat from the griddle and into an area of the at least one open top gas burner during operation of the griddle.

16. A griddle and gas burner range, comprising:

a griddle comprising an electric heating element, and a griddle plate that is disposed over the electric heating element;

at least one open top gas burner disposed adjacent to the griddle; and a heat barrier installed between the griddle and the at least one open top gas burner, so as to block the escape of the heat from the griddle and into an area of the at least one open top gas burner during operation of the griddle, wherein the heat barrier comprises an elongated plate disposed in a fire box of the griddle, wherein the elongated plate extends upward to a height above an edge of the fire box, wherein the heat barrier has a mounting flange on at least one end thereof, and wherein the mounting flange has a groove configured to fit over the electric heating element of the griddle and a through-hole which aligns with an existing mounting hole for mounting the electric heating element of the griddle to the fire box.

17. The griddle and gas burner range of claim 16, wherein a fastener is operative to mount the heat barrier by passing through the through-hole and the existing mounting hole for engagement with the fire box.

* * * * *